US006443066B2

(12) United States Patent
Stellberger

(10) Patent No.: US 6,443,066 B2
(45) Date of Patent: Sep. 3, 2002

(54) DEVICE FOR CORRECTING SKEW OF PRINTING PLATES ON A PLATE CYLINDER OF A ROTARY PRINTING MACHINE

(75) Inventor: Rudi Stellberger, Kronau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/854,659

(22) Filed: May 14, 2001

(30) Foreign Application Priority Data

May 12, 2000 (DE) ..... 100 23 213

(51) Int. Cl.[7] ..... B41F 27/12
(52) U.S. Cl. ..... 101/415.1; 101/378
(58) Field of Search ..... 101/415.1, 378, 101/409

(56) References Cited

U.S. PATENT DOCUMENTS 5,189,958 A * 3/1993 Tafel et al. ..... 101/415.1
5,488,904 A * 2/1996 Kleinschmidt et al. .. 101/415.1

FOREIGN PATENT DOCUMENTS

| | | |
|---|---|---|
| DE | 893 343 | 7/1949 |
| DE | 3936446 A1 | 5/1991 |
| DE | 4134365 A1 | 4/1993 |
| DE | 9318599 U1 | 4/1994 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A device for correcting a skew of a skewed printing plate on a plate cylinder of a rotary printing machine, comprising a front clamping bar for holding a leading edge of the printing plate; and a rear clamping device including at least one rear clamping bar for holding a trailing edge of the printing plate, an axially guided lower bar and a pivoting strip mounted so as to be pivotable about a first pivot point on said lower bar; the front clamping bar being pivotable about a second pivot point disposed approximately centrally in an axial extent of a cylinder channel formed in the plate cylinder, and the at least one rear clamping bar being mounted on the pivoting strip so that the at least one rear clamping bar is pivotable in circumferential direction about a third pivot point.

5 Claims, 3 Drawing Sheets

1
2
3
4
6
7
8
9
10
11
12
13
14
16
17
18
19
21
22;23

DEVICE FOR CORRECTING SKEW OF PRINTING PLATES ON A PLATE CYLINDER OF A ROTARY PRINTING MACHINE

BACKGROUND OF THE INVENTION

Field of the Invention

The invention relates to a device for correcting a skew of skewed printing plates on a plate cylinder of a rotary printing machine, having a front clamping bar for holding a leading edge of a printing plate and a rear clamping bar for holding a trailing edge of a printing plate. In order to be able to correct a skewed position of the printing image, the printing plate, together with the printing-plate holding device, must be capable of skew adjustment.

The published German Patent Document DE 41 34 365 A1 has already disclosed a device for correcting the skew of a printing plate, wherein the front clamping bar can be pivoted about a centrally disposed pivot point, and wherein the rear clamping bar is mounted on a freely pivotable lower bar. The corresponding entrainment of the rear clamping bar during a pivoting movement of the front clamping bar is effected by an angle lever and a coupler or connecting rod, the angle lever having a linear guide.

The clamping force for holding the printing plate on the rear clamping bar is applied by tensioning screws, which are supported on an axially adjustable tensioning wedge.

The published German Patent Document DE 39 36 446 A1 has also already disclosed the practice of providing known tensioning springs, which are supported by one end on a clamping bar and by the other end on the side wall, of the plate cylinder channel, which is fixed to the cylinder.

In this case, it is disadvantageous that, in the event of a skewed position of the rear clamping bar, the tensioning springs have different tensioning travel distances distributed over the axial length, and therefore different tensioning forces occur.

SUMMARY OF THE INVENTION

It is accordingly an object of the invention to provide a device for correcting the skew of a printing plate, the correction device being of compact construction.

With the foregoing and other objects in view, there is provided, in accordance with the invention, a device for correcting a skew of a skewed printing plate on a plate cylinder of a rotary printing machine, comprising a front clamping bar for holding a leading edge of the printing plate; and a rear clamping device including at least one rear clamping bar for holding a trailing edge of the printing plate, an axially guided lower bar and a pivoting strip mounted so as to be pivotable about a first pivot point on the lower bar; the front clamping bar being pivotable about a second pivot point disposed approximately centrally in an axial extent of a cylinder channel formed in the plate cylinder, and the at least one rear clamping bar being mounted on the pivoting strip so that the at least one rear clamping bar is pivotable in circumferential direction about a third pivot point.

In accordance with another feature of the invention, at least one compression spring for simultaneously clamping and tensioning an end of the printing plate is braced against the pivoting strip and against the at least one rear clamping bar.

In accordance with a further feature of the invention, the second pivot point about which the front clamping bar is pivotable has an axis extending through a region of the leading edge of the printing plate.

In accordance with an added feature of the invention, the first pivot point is disposed on an axis extending from the pivoting strip to the rear clamping bar at a region of the trailing edge of the printing plate.

In accordance with a concomitant feature of the invention, the first pivot point is disposed at least approximately centrally to the cylinder channel in the axial direction thereof.

An advantage of the invention resides, particularly, in that the device for correcting skew is of compact construction. In this regard, the tensioning springs for the rear clamping rail are braced against the pivoting strip which moves in synchronism with the conjointly moving rear clamping bar, so that no transverse forces act upon the spring elements.

In an advantageous construction, only a single lever is provided for entraining the rear clamping bar.

In order to leave the circumferential register unchanged during the correction to the skew of the printing plate, the second or front pivot point is located centrally on an axis extending to a region of the leading edge of the printing plate, because a previously set circumferential register thereby remains virtually unchanged. Advantageous to the same extent is the disposition of the axis through the first pivot point for the rear pivoting strip, which extends to the region of the trailing edge of the printing plate.

Other features which are considered as characteristic for the invention are set forth in the appended claims.

Although the invention is illustrated and described herein as embodied in a device for correcting skew of printing plates on a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
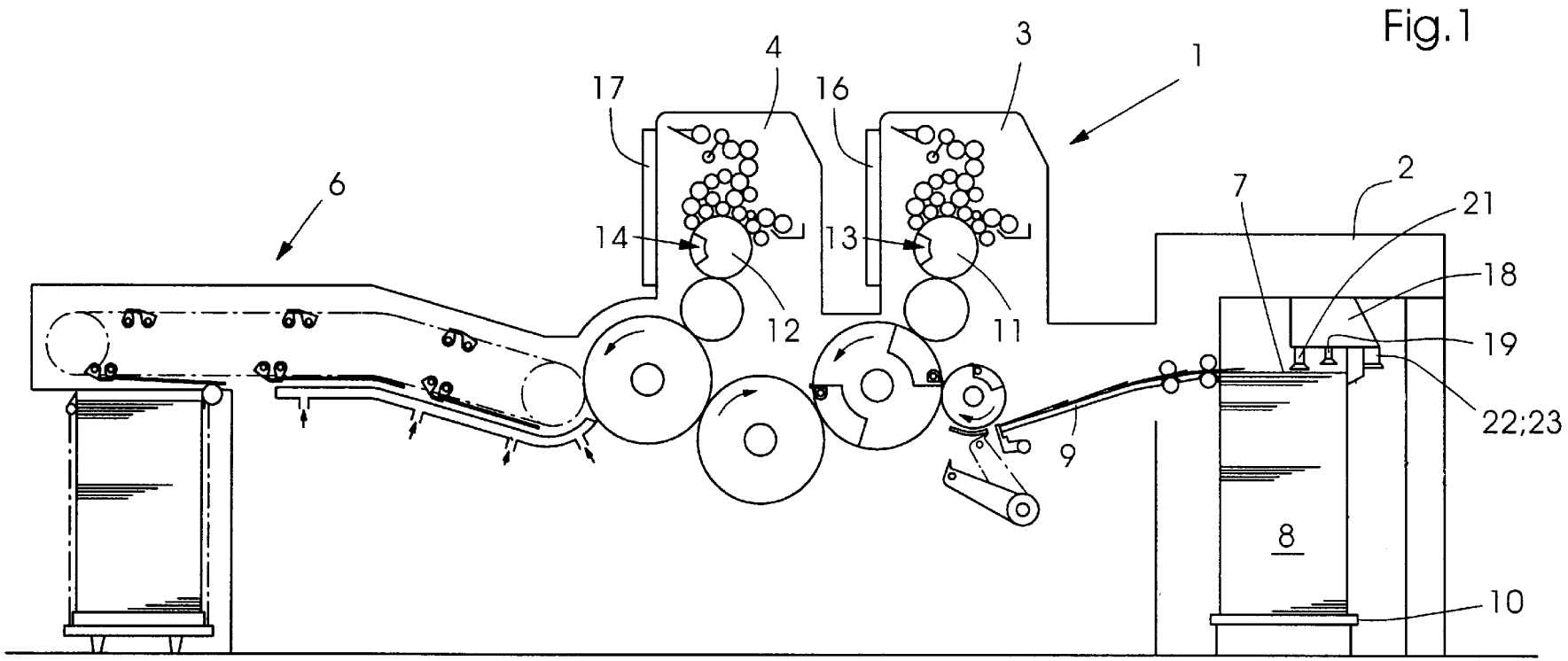
FIG. 1 is a diagrammatic side elevational view of a sheet-fed rotary printing machine incorporating the skewed plate correction device according to the invention.
Figure 2:
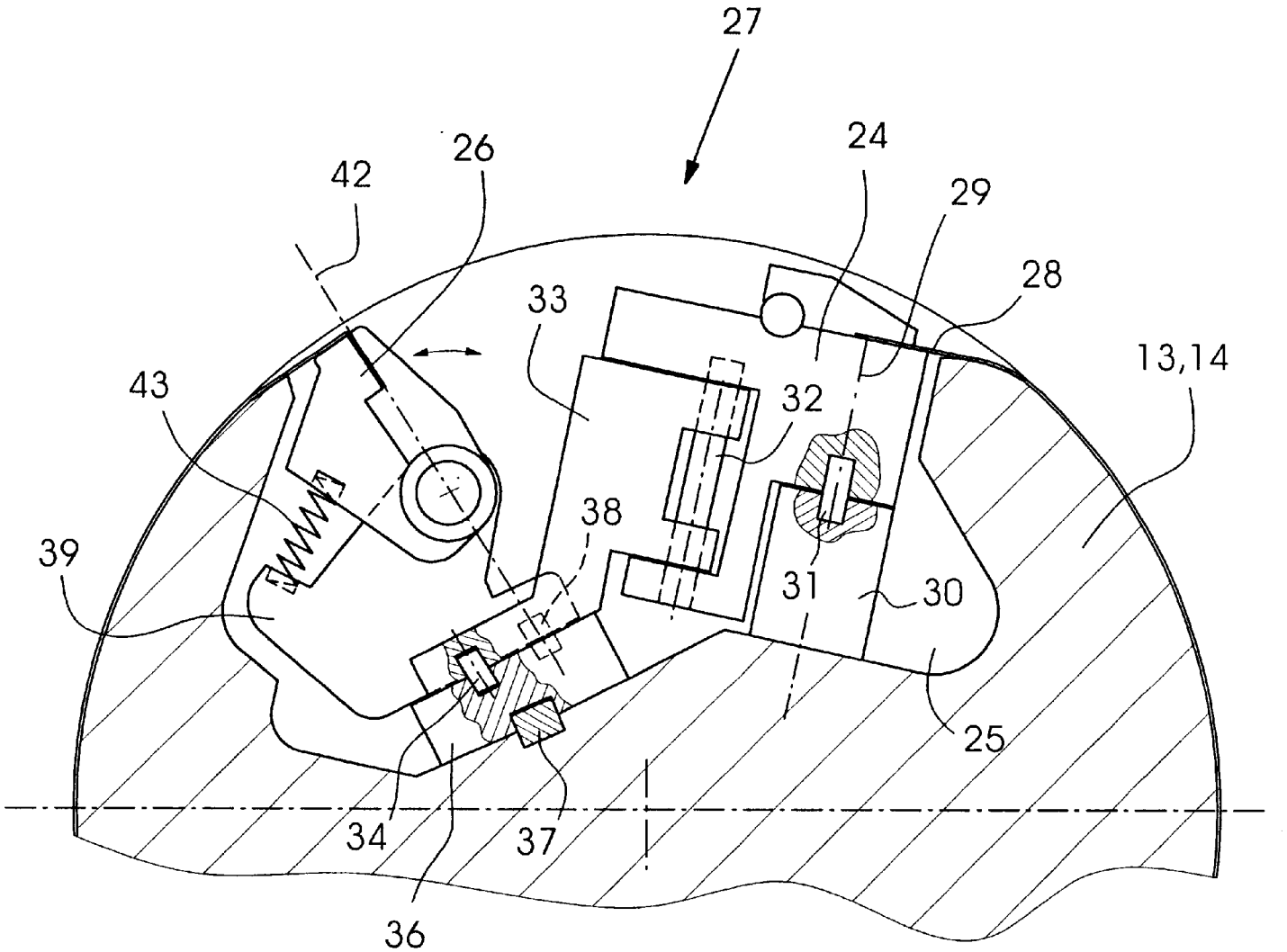
FIG. 2 is a fragmentary diagrammatic cross-sectional view of a plate cylinder with the skewed plate correction device according to the invention.
Figure 3:
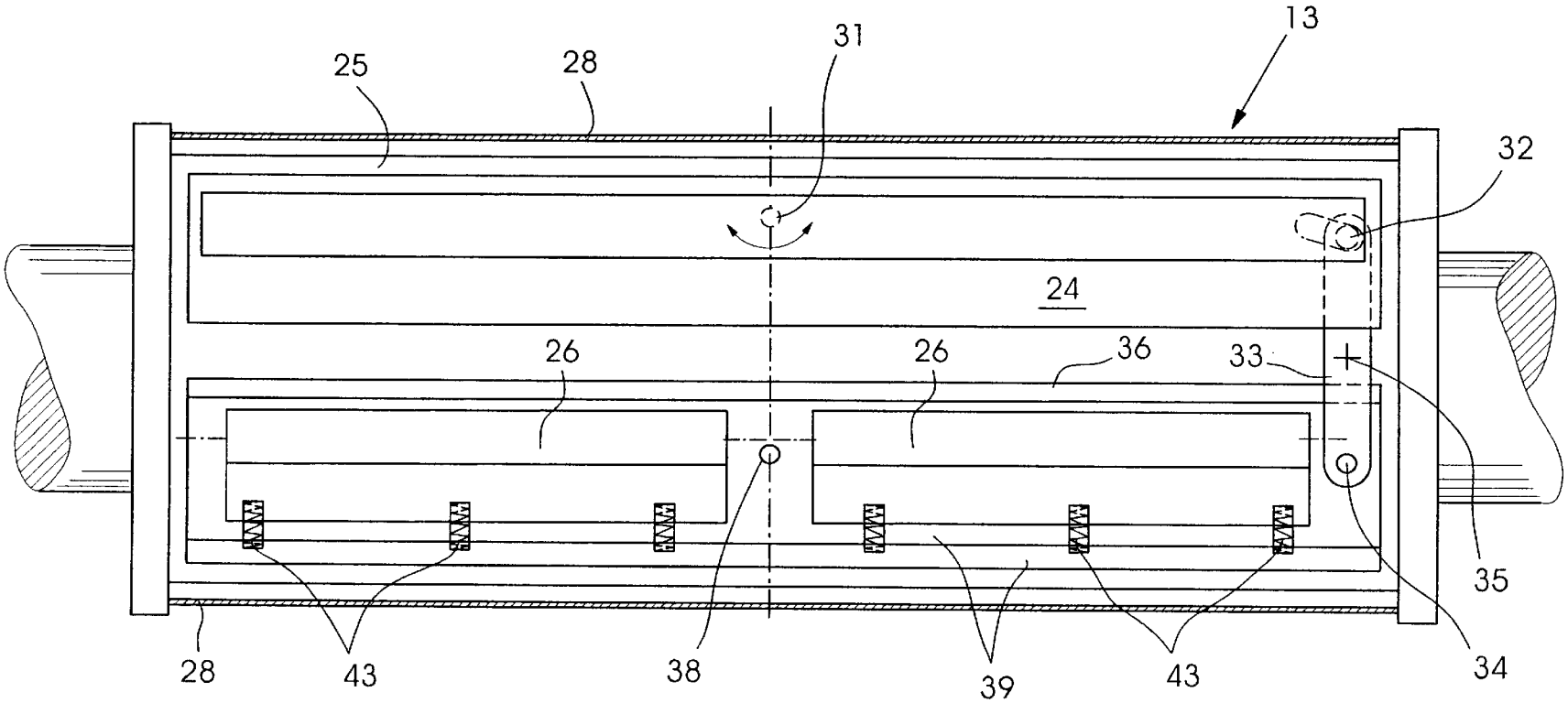
FIG. 3 is a diagrammatic axial view of a plate cylinder formed with a cylinder channel wherein a skewed-plate sheet correction device according to the invention is received.

Referring now to the drawings and, first, particularly to FIG. 1 thereof, there is shown therein a rotary printing machine, for example, a sheet-processing printing machine 1 having a feeder 2, at least one printing unit 3 and 4, respectively, and a delivery 6. Sheets 7 are taken from a sheet pile 8 and fed over a feed table 9 to the printing units 3 and 4 separately or in overlapping or imbricated formation. The printing units, respectively, include a plate cylinder 11; 12 disposed therein in a conventional manner. The plate cylinders 11 and 12, respectively, have a device 13, 14 for fastening flexible printing plates thereon. Furthermore, each plate cylinder 11; 12 has assigned thereto a device 16; 17 for semi-automatically or fully automatically changing printing plates.

The sheet pile 8 lies on a controllably liftable pile board 10. Removal of the sheets 7 takes place from the top of the sheet pile 8 by a so-called suction head 18, which has, amongst other things, a number of lifting and dragging suckers 19, 21 for separating or singling the sheets 7. In addition, blowing devices 22 for loosening the upper layers of sheets, and sensing elements 23 for tracking the pile 8 are provided. In order to align the sheet pile 8, in particular, the upper sheets 7 of the sheet pile 8, a number of lateral and rear stops are provided.

The devices 13 and 14 are structurally identical and will therefore be described hereinbelow only in terms of the device 13, which has a front or leading clamping bar 24 for clamping the leading edge of the printing plate, and a rear or trailing clamping bar 26 for clamping and tensioning the trailing edge of the printing plate. Furthermore, a device 27 for correcting the skew of the printing plate 28 is provided in a cylinder channel 25 formed in the plate cylinder 11. The skew-correcting device 27 includes, amongst other things, the clamping bar 24 for fastening the leading edge of the printing plate. The clamping bar 24 is mounted in the clamping plane of the printing plate 28 so that it can pivot on a lower bar 30 fixed to the cylinder. The pivot point is disposed centrally on the clamping bar 24, specifically, in a manner that the axis 29 of the pin 31 marking the pivot point approximately forms a tangent to the leading edge of the printing plate. At the one end thereof, the clamping bar 24 carries a shaft 32 which is disposed parallel to the pin 31 and on which a pivoting lever 33 is disposed which, with the other end thereof, pivotably engages a pin 34 belonging to a rear lower bar 36. The pivoting lever 33 has a pivot point 35 fixed to the cylinder. In order to correct the skew of the printing plate, a nonillustrated actuator fixed to the cylinder acts upon the pivoting lever 33 and pivots the latter about the pivot point 35.

The rear lower bar 36 is mounted so that it is displaceable axially with respect to the cylinder channel 25 by a linear guide 37, and bears a pin 38 disposed centrally on the lower bar 36. A pivoting strip 39 extending axially along the lower bar 36 is mounted so that it is pivotable about the pin 38. The pivoting strip 39 carries the clamping bar 26 for the trailing edge of the printing plate 28, the pivoting strip 39 being disposed so that it is pivotable in the circumferential direction of the plate cylinder 13. The pin 38 is disposed so that the axis 42 of the pin 38 at least approximately forms a tangent to the trailing edge of the printing plate 28.

A compression spring 43 is braced by one end thereof against the pivotable clamping bar 26 and by the other end thereof against the pivoting strip 39. The compression spring 43 applies the force required for clamping and tensioning the printing plate 28.

The rear clamping bar 26 can also have a multipartite construction, the clamping parts being disposed axially beside one another on the common pivoting strip 39, and each clamping part having assigned thereto at least one compression spring 43.

In order to correct the skew of the printing plates 28, the rear clamping rail 26 is initially pivoted counter to the force of the compression spring 43, while the clamping force is simultaneously maintained, in order to relieve the tension in the printing plate 28. Then, the front clamping bar 24 is pivoted by a non-illustrated actuating device about the axis 29 a desired amount of the skew correction. For the purpose of synchronizing the movement of the trailing edge of the printing plate, the pivoting lever 33 provided on one side entrains the lower bar 36 and displaces the latter axially in the guide 37 thereof. In this regard, the correction to the skew of the trailing edge of the printing plate is performed by pivoting the pivoting strip 39 about the axis 42, and thereby simultaneously with the tensioning of the trailing edge of the printing plate.

The clamping bar 26 is pivoted synchronously with the pivoting strip 39, so that no change in the position of the clamping bar 26 with respect to the pivoting strip 39 occurs, and therewith the compression springs 43 exert an unchanged, uniform clamping force on the end of the printing plate over the axial length of the clamping bar 26. After the skew correction has been performed, the end of the printing plate is subjected to tension by the provided non-illustrated actuating device, as a result of a pivoting movement in the direction of the force of the compression spring 43.

I claim:

1. A device for correcting a skew of a skewed printing plate on a plate cylinder of a rotary printing machine, comprising a front clamping bar for holding a leading edge of the printing plate; and a rear clamping device including at least one rear clamping bar for holding a trailing edge of the printing plate, an axially guided lower bar and a pivoting strip mounted so as to be pivotable about a first pivot point on said lower bar; said front clamping bar being pivotable about a second pivot point disposed approximately centrally in an axial extent of a cylinder channel formed in the plate cylinder, and said at least one rear clamping bar being mounted on said pivoting strip so that said at least one rear clamping bar is pivotable in circumferential direction about a third pivot point.

2. The correcting device according to claim 1, wherein at least one compression spring for simultaneously clamping and tensioning an end of the printing plate is braced against said pivoting strip and against said at least one rear clamping bar.

3. The correcting device according to claim 1, wherein said second pivot point about which said front clamping bar is pivotable has an axis extending through a region of said leading edge of the printing plate.

4. The correcting device according to claim 1, wherein said first pivot point is disposed on an axis extending from said pivoting strip to said rear clamping bar at a region of said trailing edge of the printing plate bar.

5. The correcting device according to claim 4, wherein said first pivot point is disposed at least approximately centrally to said cylinder channel in the axial direction thereof.

* * * * *